US010074531B2

(12) United States Patent
Sulzer et al.

(10) Patent No.: US 10,074,531 B2
(45) Date of Patent: Sep. 11, 2018

(54) IMR-MS DEVICE

(71) Applicant: IONICON ANALYTIK GESELLSCHAFT M.B.H., Innsbruck (AT)

(72) Inventors: Philipp Sulzer, Innsbruck (AT); Simone Jürschik, Innsbruck (AT); Jens Herbig, Innsbruck (AT); Alfons Jordan, Innsbruck (AT); Lukas Märk, Innsbruck (AT)

(73) Assignee: IONICON ANALYTIK GESELLSCHAFT M.B.H., Innsbruck (AT)

( * ) Notice: Subject to any disclaimer, the term of this patent is extended or adjusted under 35 U.S.C. 154(b) by 0 days.

(21) Appl. No.: 15/782,281

(22) Filed: Oct. 12, 2017

(65) Prior Publication Data

US 2018/0108522 A1 Apr. 19, 2018

(30) Foreign Application Priority Data

Oct. 14, 2016 (EP) ..... 16194037

(51) Int. Cl.
*H01J 49/16* (2006.01)
*H01J 49/00* (2006.01)
(Continued)

(52) U.S. Cl.
CPC ..... *H01J 49/168* (2013.01); *H01J 49/0009* (2013.01); *H01J 49/0027* (2013.01);
(Continued)

(58) Field of Classification Search
CPC ..... H01J 49/0027; H01J 49/0031; H01J 49/0036; H01J 49/145; H01J 49/168; H01J 49/286; H01J 49/426
See application file for complete search history.

(56) References Cited

U.S. PATENT DOCUMENTS

2006/0284075 A1* 12/2006 Bonne ..... H01J 49/10 250/288
2014/0262837 A1* 9/2014 Sidheswaran ..... G01N 33/0014 205/785.5

OTHER PUBLICATIONS

Barber et al, "Increased Sensitivity in Proton Transfer Reacgion Mass Spectrometry by Incorporation of a Radio Frequency Ion Funnel", Analytical Chemistry vol. 84, No. 12, Jun. 19, 2012 pp. 5387-5391.*

(Continued)

*Primary Examiner* — David E Smith
(74) *Attorney, Agent, or Firm* — Workman Nydegger

(57) ABSTRACT

Ion-molecule-reaction—mass spectrometry (IMR-MS) device, comprising an ion source, an adjacent reaction chamber and a mass spectrometer subsequent to the reaction chamber, wherein the reaction chamber comprises an RF device for creating a temporally changing electromagnetic field and wherein an adjustable reduced electric field strength (E/N) can be applied to the reaction chamber, characterized by an input device for entering a desired reduced electric field strength (E/N) by an operator when operating said IMR-MS device for analyzing a sample, and a controlling device that operates the IMR-MS device by adjusting the settings of the IMR-MS device relating to a defined data set of a pseudo reduced electric field strength ($PE/N_{1,2}$) for the entered reduced electric field strength (E/N), wherein the pseudo reduced electric field strength ($PE/N_{1,2}$) has been determined by analyzing a first analyte ($A_1$) in the IMR-MS device, wherein intensity signals ($RS_1$) of at least two product ions of the analyte ($A_1$) are recorded and wherein the settings of the IMR-MS device are changed until the measured intensity signal ($IS_1$) ratios of the at least two product ions match reference intensity signal ($RS_1$) ratios within a given tolerance level of the at least two product ions determined in an IMR-MS device comprising (Continued)

an ion source, an adjacent reaction chamber with a DC-drift tube and a mass spectrometer subsequent to the reaction chamber, wherein the reaction chamber is operated only with an activated DC-drift tube at a certain actual reduced electric field strength ($E_{a1}/N$), wherein these settings of the IMR-MS device relating to the pseudo reduced electric field strength ($PE/N_1$) are stored in the controlling device, wherein the controlling device controls said IMR-MS device by performing analysis of the sample with the settings corresponding to the pseudo reduced electric field strengths ($PE/N_1$).

10 Claims, 3 Drawing Sheets

(51) Int. Cl.
*H01J 49/14* (2006.01)
*H01J 49/28* (2006.01)
*H01J 49/42* (2006.01)

(52) U.S. Cl.
CPC ..... *H01J 49/145* (2013.01); *H01J 49/286* (2013.01); *H01J 49/426* (2013.01)

(56) References Cited

OTHER PUBLICATIONS

Barber et al., "Increased Sensitivity in Proton Transfer Reaction Mass Spectrometry by Incorporation of a Radio Frequency Ion Funnel", Analytical Chemistry, vol. 84, No. 12, Jun. 19, 2012, pp. 5387-5391.
EESR cited in European Application No. 16194037.4 dated Mar. 29, 2017.
González-Méndez et al., "Enhancement 1-10 of Compound Selectivity Using a Radio Frequency Ion-Funnel Proton Transfer Reaction Mass Spectrometer: Improved Specificity for Explosive Compounds", Analytical Chemistry, vol. 99, No. 21, Oct. 7, 2016, pp. 10624-10630.

* cited by examiner

| Compound group A | | Compound group B (optional) | | Compound group X (optional) | |
|---|---|---|---|---|---|
| PE/N value 1 | Settings 1 | PE/N value | Settings | PE/N value | Settings |
| PE/N value 2 (optional) | Settings 2 (optional) | ... | ... | ... | ... |
| PE/N value n (optional) | Settings n (optional) | ... | ... | ... | ... |

IMR-MS DEVICE

The present invention relates to an ion-molecule-reaction-mass spectrometry (IMR-MS) device, comprising an ion source, an adjacent reaction chamber and a mass spectrometer subsequent to the reaction chamber, wherein the reaction chamber comprises an RF device for creating a temporally changing electromagnetic field and wherein an adjustable reduced electric field strength (E/N) can be applied to the reaction chamber.

BACKGROUND OF THE INVENTION

Proton Transfer Reaction—Mass Spectrometry (PTR-MS) is a well established method for chemical ionization, detection and quantification of (trace) compounds. An overview of the theoretical background and common applications is given e.g. in A. M. Ellis, C. A. Mayhew; *Proton Transfer Reaction Mass Spectrometry Principles and Applications*; John Wiley & Sons Ltd., UK, 2014. Advantages of this technique are high sensitivity, high selectivity, on-line quantification, direct sample injection and short response times. Although most common PTR-MS instruments employ proton transfer from $H_3O^+$ to the analytes, the technology is by no means limited to this form of ionization. Several instruments have been introduced, which enable the use of $NO^+$, $O_2^+$, $Kr^+$ and any other type of positively or negatively charged reagent ions for chemical ionization. Accordingly PTR-MS devices may also be called ion-molecule-reaction-mass spectrometry (IMR-MS) devices. Both terms PTR-MS and IMR-MS are used synonymously throughout this specification.

As for most analytical instrumentation also in IMR-MS there has always been a quest for improving the instrumental sensitivity. A higher sensitivity does not only mean that lower compound concentrations can be detected, i.e. that the limit-of-detection is improved, but also, that less measurement time is needed to acquire high quality data. For nearly 20 years sensitivity improvements were mainly achieved by optimizing the established instrumental design (e.g. design of transfer lens systems, vacuum system, ion source, etc.), while no fundamentally new developments were implemented in the reaction region. That is, even though a (commercial) IMR-MS instrument from 2009 might have orders of magnitude higher sensitivity than an instrument from 1999, the measurement results are virtually identical in terms of branching ratios and quantification results, because the fundamental ionization conditions have not changed.

However, it seems that the potential of optimizing the IMR-MS setup has been fully exploited at some point, so that the introduction of novel sensitivity improving measures became necessary. One common characteristic of nearly all recent attempts to improve sensitivity is the implementation of temporally changing electromagnetic fields (e.g. via AC, or more specifically RF (radio frequency) devices, like ion funnels, multipoles, helices, etc.—here referred to as RF devices—to guide ions into, within and/or out of the reaction region, i.e. installing RF devices in a region of the IMR-MS instrument, where the mean free path of the particles is small enough so that ion-molecule interactions involving analytes can take place. In the following such a "next generation" instrument will be referred to as an "RF/IMR-MS" instrument, whereas an instrument without such an RF device will be referred to as a "classic IMR-MS" instrument. One of the first studies on an RF/IMR-MS instrument has been published by S. Barber, R. S. Blake, I. R. White, P. S. Monks, F. Reich, S. Mullock, A. M. Ellis, Increased Sensitivity in Proton Transfer Reaction Mass Spectrometry by Incorporation of a Radio Frequency Ion Funnel. Analytical Chemistry 84 (2012) 5387-5391. Their aim was to considerably reduce the ion losses that inevitably occur at the exit aperture of the drift tube. Thus, they constructed a drift tube with an implemented ion funnel, i.e. the first half of the drift tube consisted of stainless steel plates with constant orifice diameters in the cm region, whereas the second half had plates with successively decreasing orifice diameters down to the mm region at the final plate. When applying an RF voltage in addition to the DC voltage, the second half acted as an ion funnel (see U.S. Pat. No. 6,107,628) and focused the ions into the mass spectrometer. Barber et al. demonstrated that the RF ion funnel increased the sensitivity of some compounds by a factor of 200 and more.

Another example of a sensitivity improving RF device in a IMR-MS instrument has been published by Sulzer et al. in 2014 (P. Sulzer, E. Hartungen, G. Hanel, S. Feil, K. Winkler, P. Mutschlechner, S. Haidacher, R. Schottkowsky, D. Gunsch, H. Seehauser, M. Striednig, S. Jürschik, K. Breiev, M. Lanza, J. Herbig, L. Märk, T. D. Märk, A. Jordan, A Proton Transfer Reaction-Quadrupole interface Time-Of-Flight Mass Spectrometer (PTR-QiTOF): High speed due to extreme sensitivity; International Journal of Mass Spectrometry 368 (2014) 1-5). They used a IMR-MS instrument with a quadrupole ion guide in the transfer region between the drift tube and the mass spectrometer in order to focus the ions and reduce ion losses in this region. An increase in sensitivity by a factor of 25 has been reported for this instrumental setup. Furthermore, the introduction of a quadrupole ion guide had a positive effect on the injection conditions into the mass spectrometer, which resulted in a considerable increase of mass resolution.

A third example is given in WO 2015/024033 wherein the whole reaction region is enclosed by electrodes which are in the form of helices and which replace the common stainless steel rings of the IMR-MS drift tube. (Varying) RF voltages are applied to these electrodes. One of the main advantages of the introduced setup is that it is capable of considerably increasing the instrumental sensitivity.

Besides these three examples, any other types of RF devices (e.g. multipoles, combinations of ion funnels and multipoles, etc.), any positions (e.g. beginning of the reaction region, replacing or complementing the drift tube, end of the reaction region) and any combinations could lead to performance improvements. However, all embodiments of an RF/IMR-MS instrument share one crucial disadvantage: The E/N of the reaction region cannot be calculated by simply dividing equation (1) by equation (2) anymore (see below), as at least some ion-molecule reactions take place in the RF device.

Barber et al. address this issue in their 2012 publication: " . . . *E/N of a combined ion funnel/drift tube, with its contribution from both dc and ac electric fields, is no longer obvious*." As a solution they suggest the introduction of the empirical parameter "effective E/N". The concept behind this parameter is, that the reaction region is operated in DC only mode, i.e. in the classic mode where the E/N can be easily calculated, and the ratio between the reagent ions $H_3O^+$ and $H_3O^+(H_2O)$ is obtained at 10 different E/N settings within a reasonable E/N range (about 65 to 165 Td). Subsequently, the reaction region is switched to RF mode and the authors approximate the $H_3O^+$ to $H_3O^+(H_2O)$ ratios obtained in DC only mode by adjusting the peak-to-peak amplitude of the AC voltage, while keeping the DC voltage applied to the drift tube constant at 100 V. Finally, they assign those RF mode settings resulting in $H_3O^+$ to $H_3O^+(H_2O)$ ratios comparable to a corresponding E/N in DC only mode, the DC only mode E/N and denominate this value as "effective E/N".

For other types of RF/IMR-MS instruments, there are no concepts to overcome the problem of unknown E/N other than claiming the contribution of the RF device on E/N was minor and could be neglected. Additionally, there are no concepts to overcome the problem for reagent ion different to $H_3O^+$.

Problem to be Solved

Hence, the object of the present invention is to provide an improved PTR-MS or IMR-MS device, comprising an ion source, an adjacent reaction chamber and a mass spectrometer subsequent to the reaction chamber, wherein the reaction chamber comprises an RF device for creating a temporally changing electromagnetic field and wherein an adjustable reduced electric field strength (E/N) can be applied to the reaction chamber. In particular this device should provide measurement results that can easily be compared with those results obtained with a PTR-MS or an IMR-MS device without RF device but only a drift tube.

This object is solved by an ion-molecule-reaction-mass spectrometry (IMR-MS) device, comprising (i) an ion source, (ii) an adjacent reaction chamber and (iii) a mass spectrometer subsequent to the reaction chamber, wherein the reaction chamber comprises an RF device for creating a temporally changing electromagnetic field and wherein an adjustable reduced electric field strength (E/N) can be applied to the reaction chamber, characterized by an input device for entering a desired reduced electric field strength (E/N) by an operator when operating said IMR-MS device for analysing a sample, and a controlling device that operates the IMR-MS device by adjusting the settings of the IMR-MS device relating to a defined data set of a pseudo reduced electric field strength ($PE/N_{1,2}$) for the entered reduced electric field strength (E/N), wherein the pseudo reduced electric field strength ($PE/N_{1,2}$) has been determined by analysing a first analyte ($A_1$) in the IMR-MS device, wherein intensity signals ($RS_1$) of at least two product ions of the analyte ($A_1$) are recorded and wherein the settings of the IMR-MS device are changed until the measured intensity signal ($IS_1$) ratios of the at least two product ions match reference intensity signal ($RS_1$) ratios within a given tolerance level of the at least two product ions determined in an IMR-MS device comprising an ion source, an adjacent reaction chamber with a DC-drift tube and a mass spectrometer subsequent to the reaction chamber, wherein the reaction chamber (15) is operated only with an activated DC-drift tube at a certain actual reduced electric field strength ($E_{a1}/N$), wherein these settings of the IMR-MS device relating to the pseudo reduced electric field strength ($PE/N_1$) are stored in the controlling device, wherein the controlling device controls said IMR-MS device by performing analysis of the sample with the settings corresponding to the pseudo reduced electric field strengths ($PE/N_1$).

Before explaining the advantages of the invention in detail, first a description of a IMR-MS or device is provided below.

Ion Source

In the ion source the reagent ions are formed. Many IMR-MS instruments employ a hollow cathode ion source fed by suitable source gases (e.g. $H_2O$ vapor, $O_2$, $N_2$, noble gases, etc.), but various other designs have been introduced (e.g. point discharge, plane electrode discharge, microwave discharge, radioactive, etc.). Favorable ion sources produce reagent ions of high purity, either because of their sophisticated design or because of the use of mass filters (A. Spesyvyi, D. Smith, P. Spanel, Selected ion flow-drift tube mass spectrometry, SIFDT-MS: quantification of volatile compounds in air and breath. Analytical Chemistry 87/24 (2015) 12151-12160).

Drift Tube

The drift tube can be considered as the most critical part of a IMR-MS instrument, as chemical ionization of the analytes via interactions with the reagent ions takes place in this region. Thus, the drift tube is also referred to as reaction region. While a certain flow of gas containing the analytes is continuously injected, a uniform electric field draws ions along the drift tube. Thus, sometimes the drift tube is referred to as flow-drift tube. Commonly air containing traces of impurities (e.g. traces of volatile organic compounds) is analyzed by IMR-MS, but many other matrices containing compounds of interest (e.g. remaining impurities in purified gases, gas standards, etc.) have been successfully investigated with various reagent ions. In some embodiments the matrix containing the analytes (e.g. air with traces of volatile organic compounds) is diluted with a buffer gas prior to injection into the drift tube (e.g. for simple dilution purposes, for the use of particular reagent ions or for operating particular variants of IMR-MS such as e.g. SIFDT-MS).

Some of the common reactions between the reagent ion and the analyte taking place in the drift tube are:

Proton transfer reactions, either non-dissociative or dissociative, with A being the reagent ion (in most cases $H_2O.H^+$) and BC being the analyte $$A.H^+ + BC \rightarrow A + BC.H^+$$

$$A.H^+ + BC \rightarrow A + B + C.H^+$$

Charge transfer reactions, either non-dissociative or dissociative, with A being the reagent ion (e.g. $O_2^+$, $NO^+$, $Kr^+$, etc.) and BC being the analyte:

$$A^+ + BC \rightarrow A + BC^+$$

$$A^+ + BC \rightarrow A + B + C^+$$

Clustering reactions, with A being the reagent ion (e.g. $H_3O^+$, $NO^+$, etc.) and BC being the analyte:

$$A^+ + BC \rightarrow BC.A^+$$

In addition other types of reactions can occur (e.g. ligand switching, $H^+$ extraction in case of negatively charged reagent ions, etc.).

Most common drift tubes consist of a series of ring electrodes electrically connected via resistors with equal resistance (other reported embodiments are e.g. tubes with resistive coating), so that a DC voltage U can be applied across a drift tube of the length d, resulting in the electric field strength E:

$$E = U/d \text{(in } V/\text{cm)} \quad (1).$$

Another important drift tube parameter is the gas number density N, which is defined by equation (2):

$$N = \frac{N_A}{V_M} \frac{273.15}{T_d} \frac{P_d}{1013.25} \quad (2)$$

Here, $N_A$ is the Avogadro constant ($6.022\times10^{23}$ $mol^{-1}$), $V_M$ ($22.414\times10^3$ $cm^3$ $mol^{-1}$) is the molar volume at 1013.25 hPa and at 273.15 K, $T_d$ is the temperature in K and $P_d$ is the pressure in hPa in the drift tube.

Dividing E by N leads to the reduced electric field strength, which is related to the collision energies of ion-molecule reactions in the drift tube and most commonly simply denoted as E/N with the unit Townsend (1 Td=$10^{-17}$ V $cm^2$). However, E/N is of utmost importance because of the following effects (effects are given for a IMR-MS instrument operated with $H_3O^+$ reagent ions and sampling air, for other reagent ions and matrices they apply accordingly):

a) At low E/N, even if the ion source injects $H_3O^+$ reagent ions with nearly 100% purity, these immediately cluster with $H_2O$ molecules to $H_3O^+(H_2O)_n$ with n>0. Thus, the ion chemistry becomes extremely complex, one of the main advantages of IMR-MS, namely that quantification can be performed on-line without the need of calibration standards, is lost and mass spectra become difficult to interpret.

b) At high E/N even the "soft" ionization method IMR-MS, which is known to produce primarily protonated molecules, shows a high level of fragmentation of the analytes. This again makes quantification difficult (fragment ions have to be taken into account) and mass spectra complex.

c) For standard analysis most users choose as a trade-off an E/N which results in negligible $H_3O^+(H_2O)_n$ clustering (n>0), while keeping fragmentation of analyte molecules low. In many cases, when trace compounds in air have to be ionized, this is about 130 Td, but for analyte molecules that show high levels of fragmentation also an E/N of about 95 Td is sometimes reported. The parameter used for adjusting E/N is almost exclusively the voltage applied across the drift tube, because, in contrast to temperature and pressure, this voltage can be changed very rapidly. For a IMR-MS instrument with 9.3 cm drift tube length operated at 333 K and 2.3 hPa this equals a voltage U of 600 and 450 V, respectively. However, the crucial fact is that the E/N can be easily calculated from the instrumental parameters and is a universal parameter, independent of the model or manufacturer of the IMR-MS instrument. Thus, it is considered as good scientific practice to state the utilized E/N when publishing product ion intensities or ratios. Moreover, plotting product ion ratios (e.g. in percent) against E/N over a reasonable range (e.g. 70 to 200 Td) with reasonable E/N steps (e.g. 5 to 20 Td) has become common in publications on IMR-MS investigations of substances and is known as "branching ratio" plots. Such information serves as valuable information which product ion ratios can be expected for a distinct analyte in a distinct matrix at a set E/N.

Example: It is known from literature or from the analysis of a standard that the branching ratio of compound X in $N_2$ at 130 Td is 50% on the protonated molecule. Therefore, if compound X needs to be quantified via calculation (see "calculation of concentration") at 130 Td, the resulting concentration value has to be multiplied by a factor of 2.

d) More recently, it has been found that branching ratios can considerably improve the selectivity of IMR-MS analysis. A tentative identification of an unknown substance can be done based on the nominal (in case a low resolution mass spectrometer is used) or on the exact (in case a high resolution mass spectrometer is used) mass of the protonated molecule. Comparing the product ion branching ratios of the tentatively identified compound with the branching ratios of standards can lead to a rather unambiguous identification and, in some cases, even allows for the separations of isomers.

Example: At E/N=100 Td it is known from literature that the branching ratio for compound X is 80% on the protonated molecule at nominal m/z (mass to charge ratio) A and 20% on the fragment ion at nominal m/z B. For compound Y, which possesses the same nominal mass as compound X and for which the mass resolution of the utilized IMR-MS instrument is insufficient for separating the compounds via the exact masses of the product ions, the branching ratio is 10% on the protonated molecule at nominal m/z A and 90% on the fragment ion at nominal m/z B. An unknown compound Z (which is either X or Y) yields signal at the nominal m/z A and B. By comparing the measured branching ratios of compound Z at E/N=100 Td with the branching ratios from literature, compound Z can be identified as compound A or B with a high level of confidence. The level of confidence can be further increased by repeating the process for multiple E/N values.

In summary it can be concluded that a IMR-MS measurement at an unknown E/N is virtually worthless as neither quantification nor identification nor scientific publication of the results are possible.

Mass Spectrometer

Various types of mass spectrometers have been employed in IMR-MS instruments. The most prominent example for a low resolution mass spectrometer is the quadrupole mass filter, whereas for high mass resolution measurements Time-Of-Flight (TOF) analyzers are commonly used in IMR-MS. However, the use of other types of mass spectrometers, such as e.g. ion trap analyzers, has also been reported and even $MS^n$ could be realized. The mass spectrometer separates the ions injected from the drift tube according to their m/z and quantifies the ion yields of the separated m/z with a suitable detector (e.g. secondary electron multiplier, microchannel plate, etc.). It has to be noted that each mass spectrometer has a mass dependent ion transmission, which is further influenced by the transfer system between the drift tube and the analyzer and other devices. Therefore, in order to get comparable measurement results and, even more importantly, comparable branching ratios, the obtained ion yields should be corrected for the mass dependent transmission. This can be done rather easily by analyzing a gas standard containing well-defined amounts of compounds distributed over a (preferably) broad mass range and approximating the correction factors with an appropriate fitting function. With this fitting function the correction factors for all relevant m/z can be calculated with high accuracy.

Calculation of Concentration

One of the numerous benefits of IMR-MS is that concentrations can be calculated directly from the measured ion yields:

$$\frac{i[MH^+]}{i[H_2O^+]} = k[M]t. \quad (3)$$

In equation (3) $i[MH^+]$ is the ion yield of the protonated compound M and $i[H_3O^+]$ the ion yield of the reagent ion, both measured at the detector of the mass spectrometer. k is the rate coefficient of the proton transfer from the reagent ion to the analyte (if not known from literature, for $H_3O^+$ as reagent ions $k=2\times10^{-9}$ $cm^3$ $s^{-1}$ is a good approximation for most compounds) and t the reaction time, which can be calculated from instrumental parameters. Thus, [M], the absolute concentration of compound M, and subsequently the volume mixing ratio (in the sample) can be easily calculated.

Definitions

Reaction region: Any region in a IMR-MS instrument where the mean free path is small enough that ion-molecule reactions involving analytes can occur. In a classic IMR-MS instrument the drift tube is the reaction region.

Classic IMR-MS instrument: IMR-MS instrument as defined in the "Background" section. No RF device is installed in the reaction region. For instance, a IMR-MS instrument utilizing a quadrupole mass filter, a multipole mass filter, an ion trap, etc. as mass spectrometer is considered as a classic IMR-MS instrument as the RF device is not installed in the reaction region. A IMR-MS instrument equipped with a (multipole) mass filter in the ion source is considered as a classic IMR-MS instrument, as the RF device is not installed in the reaction region, because no ion-molecule reactions involving analytes occur in the RF device.

RF/IMR-MS instrument: IMR-MS instrument as defined in the "Background" section that incorporates at least one RF device in the reaction region. For instance, a IMR-MS instrument which incorporates a multipole ion guide for transferring the ions from the drift tube to the mass spectrometer is considered as an RF/IMR-MS instrument, if ion-molecule reactions can occur in the ion guide (i.e. if the ion guide is within the reaction region). The introduction of RF devices can fundamentally change the design of certain components of the IMR-MS instrument, e.g. the drift tube can be primarily a flow tube with an applied RF field.

Actual E/N: E/N of a classic IMR-MS instrument that can be directly calculated.

PE/N value: Dimensionless quantity which is connected to various settings of an RF/IMR-MS instrument. Applying these settings to the RF/IMR-MS instrument result in product ion ratios for distinct compounds, which are comparable to product ion ratios of same compounds produced by a classic IMR-MS instrument at a certain actual E/N.

PE/N settings: Batch of settings relating to parameters of the reaction region of an RF/IMR-MS instrument and corresponding to a specific PE/N value.

PE/N method: A PE/N value is applied to an RF/IMR-MS instrument, so that respective PE/N settings modify conditions in the reaction region in a way that for certain compounds (or certain groups of compounds) product ion intensity ratios of said compounds are comparable to product ion intensity ratios of said compounds obtained with a classic IMR-MS instrument at corresponding actual E/N.

PE/N device: Device that accepts the input of PE/N values and controls devices, which affect the reaction region of an RF/IMR-MS instrument, according to PE/N settings corresponding to said PE/N values stored in a database, so that respective PE/N settings modify conditions in the reaction region in a way that for certain compounds (or groups of compounds) product ion intensity ratios of said compounds are comparable to product ion intensity ratios of said compounds obtained with a classic IMR-MS instrument at corresponding actual E/N.

The term PTR-MS and IMR-MS are used synonymously throughout this specification.

An ion-molecule-reaction-mass spectrometry (IMR-MS) device, comprising an ion source, an adjacent reaction chamber and a mass spectrometer subsequent to the reaction chamber, wherein the reaction chamber comprises an RF device for creating a temporally changing electromagnetic field and wherein an adjustable reduced electric field strength (E/N) can be applied to the reaction chamber is abbreviated as RF/IMR-MS device throughout the text.

ADVANTAGES AND FURTHER DETAILS OF THE INVENTION

Further details and advantages of the invention will be described below. For better illustration reference is made to the Figures FIG. 1 shows a Schematic view of an example of an RF/IMR-MS instrument.

Figures 1, 2:
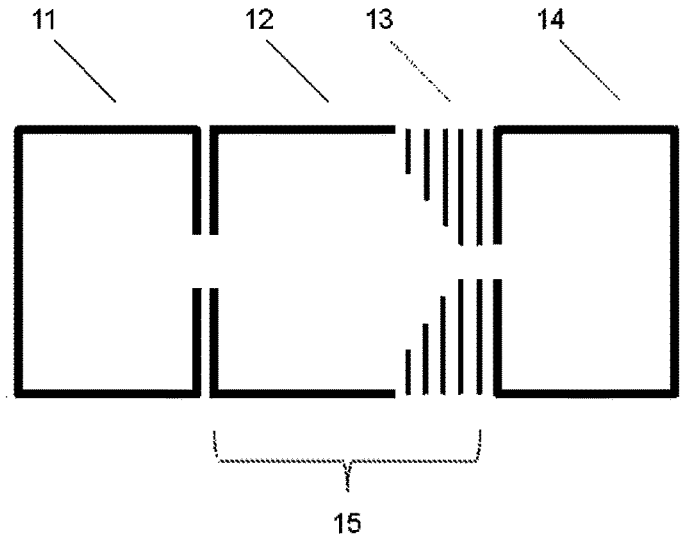
FIG. 2 shows an example of the format PE/N settings could be stored in a database

Via theoretical considerations and by constructing an RF/IMR-MS instrument which incorporates an RF device such as an ion funnel between the common drift tube and the transfer lens system of the mass spectrometer, we found that the established and so far exclusive method of solving the E/N problem, namely the "effective E/N method" (Barber et al.), although having been introduced by pioneers in the field of RF/IMR-MS instruments, is highly inaccurate. The pressures typically used in the drift tube of a IMR-MS instrument are between 1 and 1000 hPa. According to the laws of physics, the mean free path, i.e. the average distance a moving particle travels between two successive impacts, is in the region of about $10^{-4}$ to $10^{-7}$ m in this pressure range. Thus, even at the lower end of the typical pressure range in a drift tube, i.e. at about 1 hPa, a multitude of collisions will take place within every mm the particle travels. Assuming that the IMR-MS instrument is being operated with $H_3O^+$ reagent ions (produced from neutral $H_2O$, which will inevitably enter the reaction region in a certain amount) and is sampling ambient air (which contains humidity), it is obvious that several percent of the neutral molecules in the reaction region will be $H_2O$ molecules. As elaborated above at low E/N, collisions between $H_3O^+$ and $H_2O$ effectively form $H_3O^+(H_2O)_n$ with $n>0$. Thus even a very short (compared to typical reaction region lengths around 10 cm) region of low E/N at the very last part of the reaction region (i.e. even at lower pressures than 1 hPa (e.g. at about 0.01 hPa in a multipole ion guide between the drift tube and the mass spectrometer), but before the ions enter the high vacuum of the mass spectrometer, where no more particle interactions take place because of the large mean free path)

will have a considerable influence on the $H_3O^+$ to $H_3O^+(H_2O)$ ratio. In other words, if the first 95% of the reaction region are operated at an E/N of e.g. 250 Td, but the final 5% at a considerably lower E/N, the "effective E/N" derived from the $H_3O^+$ to $H_3O^+(H_2O)$ ratio measured at the mass spectrometer could in this case be e.g. 90 Td. However, 95% of the ionization reactions of the analytes will take place at 250 Td (i.e. very high E/N) and once an analyte molecule has undergone dissociation, which is very likely at such a high E/N, it cannot recombine in the final 5% of low E/N. Thus, although the user thinks the measurement results had been obtained at 90 Td they have in fact been obtained at 250 Td.

In other words: In a reaction region with various areas of different E/N (some very high, some very low) the ratio between e.g. $H_3O^+$ and $H_3O^+(H_2O)$ can shift from predominantly $H_3O^+$ to predominantly $H_3O^+(H_2O)$ and back, i.e. cluster break-up and clustering can occur numerous times. In contrast, if an analyte molecule fragments at one point, it can never recombine to the original protonated molecule anymore, which is why the "effective E/N" method does not work.

Example: It is known from literature that PTR ionization of compound X with $H_3O^+$ as reagent ions at 90 Td in air is virtually non-dissociative, i.e. about 100% of the resulting product ions are protonated molecules, and at 250 Td it is predominantly dissociative (5% protonated molecules, 95% fragment ions). Therefore, if compound X needs to be quantified at 90 Td via calculation (based on equation (3)), the resulting concentration value can be used without any corrective measures. However, if the 90 Td have been determined as "effective E/N" according to the above-mentioned example but the E/N has been 250 Td over 95% of the reaction region, not correcting the concentration value derived from the protonated molecule of compound X will lead to an error by a factor of about 20.

As the intensity distributions of $H_3O^+$ and $H_3O^+(H_2O)_n$ (with n>0) clusters, which are detected at the mass spectrometer, predominantly depend on the E/N in the very last part of the reaction region, another problem arises. For an accurate calculation of concentration (based on equation 3) the intensity (current or counts-per-second (cps)) of the reagent ions needs to be known. Thus, if in the example above 95% of the PTR ionization via $H_3O^+$ has occurred at a completely different $H_3O^+$ intensity than the one that is measured with the mass spectrometer/detector, the concentration calculation will be highly erroneous.

In many embodiments of RF/IMR-MS instruments, it will not be possible to determine any actual E/N at all because of the complex and sometimes inhomogeneous nature of the applied electric field. By definition an RF field implies temporally changes of the electric field. Depending on the geometry and the design of the reaction region, the field can be dependent on the position and/or can change its frequency, phase, etc.

In order to overcome the massive problem of unknown E/N in RF/IMR-MS, we invented the method of "Pseudo E/N" (PE/N). With the PE/N method knowledge of the actual E/N in the reaction region of an RF/IMR-MS instrument becomes obsolete, which is of tremendous advantage. An RF/IMR-MS instrument equipped with PE/N functionality can be operated just like any classic IMR-MS instrument, but offers the advantages of next generation RF/IMR-MS instruments, such as increased sensitivity and/or increased mass resolution.

One key finding behind the method of using PE/N is: The reason which makes E/N so valuable and indispensable is not, what a person skilled in the art might think, the importance of knowing the reduced electric field strength in the reaction region itself, but having a measure that characterizes the ionization process. That is, it is not important to know the actual E/N, but it is essential to know the effects the actual E/N has on the chemical ionization. Thus, it is not necessary to know the complex, position and/or time dependent E/N distribution in an RF/IMR-MS instrument, but in order to preserve nearly all advantages of knowing the actual E/N, it is absolutely sufficient to be able to set a PE/N value in the RF/IMR-MS instrument, which enables branching ratios of distinct analytes to be obtained that are comparable to the ones obtained with a classic IMR-MS instrument operated at a certain actual E/N. Preferably the PE/N value equals the value of the actual E/N.

The method and device of this invention enables the user to set a PE/N value that controls an RF/IMR-MS instrument in such a way that the branching ratios of distinct analytes are comparable to the branching ratios of same analytes obtained with a classic IMR-MS instrument operated at an actual E/N of (preferably) the same value as the PE/N value (although any offset or factor could be applied to the PE/N value). For instance, if the PE/N value is set to "130", the RF/IMR-MS instrument will produce branching ratios of distinct analytes which are comparable (i.e. within a defined error range) to the branching ratios of same analytes obtained with a classic IMR-MS instrument at an actual E/N of 130 Td.

If a PE/N value is set, one or more settings which influence ion-molecule reactions in the reaction region of an RF/IMR-MS instrument are set. These parameters can be, but are not limited to: RF amplitude, RF frequency, RF phase, DC offset of the RF voltage, DC voltage gradients applied across the whole or parts of the reaction region, various ion lenses, pressure in the reaction region, temperature in the reaction region, etc.

In a preferred embodiment the IMR-MS device is further characterized in that said controlling device operates the IMR-MS device by taking the settings of the IMR-MS device relating to at least two data sets of pseudo reduced electric field strengths ($PE/N_{1,2}$) for the entered reduced electric field strength (E/N), by analysing a second analyte ($A_2$), wherein the procedure for the first analyte is repeated for the at least second analyte ($A_2$) to obtain a second pseudo reduced electric field strength ($PE/N_2$), wherein the controlling device operates said IMR-MS device by performing analysis of the sample with the setting corresponding to the at least two pseudo reduced electric field strengths ($PE/N_{1,2}$).

In one embodiment of the invention the reference intensity signals ($RS_{1,2}$) of the at least two product ions are taken from a database. This has the advantage that the operator may quickly perform his measurements.

In another embodiment the reference intensity signals ($RS_{1,2}$) of the at least two product ions were measured in an IMR-MS device comprising an ion source 11, an adjacent reaction chamber 15 with a DC-drift tube 12 and a mass spectrometer 14 subsequent to the reaction chamber 15, wherein the reaction chamber 15 is operated with an activated DC-drift tube at a certain actual reduced electric field strength with a de-activated RF device 13 if present. Hence, the operator of the device may measure his own reference intensity signals.

Therefore, the IMR-MS device may further comprise a DC-drift tube 12 in said reaction chamber. This enables an exact calibration of the device.

One embodiment is characterized in that the reference intensity signals ($RS_{1,2}$) are determined in said IMR-MS device with activated DC-drift tube and de-activated RF device.

Said RF device 13 is preferably an ion funnel or a multipole (such as quadrupol, hexapol, etc.) ion guide.

The IMR-MS device may be a IMR-MS device being operated with $H_3O^+$ reagent ions.

One aspect of the invention comprises a method of analysing a sample by an ion molecule reaction-mass spectrometry (IMR-MS) device that comprises (i) an ion source 11

(ii) an adjacent reaction chamber 15 and (iii) a mass spectrometer 14 subsequent to the reaction chamber 15, wherein an adjustable reduced electric field strength (E/N) can be applied on the reaction chamber 15, the reaction chamber 15 comprising a RF device 13 for creating a temporally changing electromagnetic field, characterized in that an operator may enter a desired reduced electric field strength (E/N) when operating said IMR-MS device, wherein the settings of the IMR-MS device are adjusted to settings relating to a defined data set of a pseudo reduced electric field strength ($PE/N_{1,2}$) for the entered reduced electric field strength (E/N), wherein the pseudo reduced electric field strength ($PE/N_{1,2}$) has been determined by analysing a first analyte ($A_1$) in an IMR-MS device, wherein intensity signals ($RS_1$) of at least two product ions of the analyte ($A_1$) are recorded and wherein the settings of the IMR-MS device are changed until the measured intensity signal ($IS_1$) ratios of the at least two product ions match reference intensity signal ($RS_1$) ratios within a given tolerance level of the at least two product ions determined in an IMR-MS device comprising an ion source 11, an adjacent reaction chamber 15 with a DC-drift tube 12 and a mass spectrometer 14 subsequent to the reaction chamber 15, wherein the reaction chamber 15 is operated only with an activated DC-drift tube at a certain actual reduced electric field strength ($E_{a1}/N$), wherein these settings of the IMR-MS device are stored relating to the pseudo reduced electric field strength ($PE/N_1$), wherein the IMR-MS device is operated by using the settings of IMR-MS device stored as pseudo reduced electric field strength ($PE/N_1$) performing analysis of the sample with the settings corresponding to the pseudo reduced electric field strengths ($PE/N_1$).

A further aspect of the invention comprises a method of calibrating an ion molecule reaction-mass spectrometry (IMR-MS) device that comprises (i) an ion source 11

(ii) an adjacent reaction chamber 15 and (iii) a mass spectrometer 14 subsequent to the reaction chamber 15, wherein the reaction chamber 15 comprises a RF device 13 for creating a temporally changing electromagnetic field and wherein an adjustable reduced electric field strength (E/N) can be applied to the reaction chamber 15, characterized by a controlling device that operates the IMR-MS device by adjusting the settings of the IMR-MS device relating to a defined data set of a pseudo reduced electric field strength ($PE/N_{1,2}$) for the entered reduced electric field strength (E/N), wherein the pseudo reduced electric field strength ($PE/N_{1,2}$) is determined by analysing a first analyte ($A_1$) in the IMR-MS device, wherein intensity signals ($RS_1$) of at least two product ions of the analyte ($A_1$) are recorded and wherein the settings of the IMR-MS device are changed until the measured intensity signal ($IS_1$) ratios of the at least two product ions match reference intensity signal ($RS_1$) ratios within a given tolerance level of the at least two product ions determined in an IMR-MS device comprising an ion source 11, an adjacent reaction chamber 15 with a DC-drift tube 12 and a mass spectrometer 14 subsequent to the reaction chamber 15, wherein the reaction chamber 15 is operated only with an activated DC-drift tube at a certain actual reduced electric field strength ($E_{a1}/N$), wherein these settings of the IMR-MS device relating to the pseudo reduced electric field strength ($PE/N_1$) are stored in the controlling device.

In order to further illustrate the PE/N method, here we use the RF/IMR-MS instrument schematically displayed in FIG. 1. However, the method is by no means limited to this type of RF/IMR-MS instrument, but can be applied to any RF/IMR-MS instrument operated with any reagent ions.

The elements 11, 12 and 14 in FIG. 1 are the elements of a classic IMR-MS instrument as described in above, i.e. 11 is an ion source for generating the reagent ions, 12 is a common IMR-MS drift tube consisting of a series of identical ring electrodes with a DC voltage gradient applied to the ring electrodes and 14 is a mass spectrometer. Additionally, necessary devices for controlling voltages and currents as well as the vacuum are present, but not shown in the figure. The RF device 13 is an ion funnel similar to the one described U.S. Pat. No. 6,107,628. By installing RF device 13 instead of a small exit aperture at element 12 and operating it with appropriate DC and RF voltages the maximum sensitivity of the instrument is significantly higher compared to the classic IMR-MS instrument. The length of RF device 13 is about ⅓ of the length of 12 (ratio about 3:9.5 cm). Although the exact contribution of RF device 13 to the ionization process of the analytes is unknown (because of the underlying problem the present invention is dealing with), it is clear that the contribution of RF device 13 cannot be neglected. The installation of RF device 13 instead of an exit aperture at the end of 12, which is facing 14, converts the classic IMR-MS instrument into an RF/IMR-MS instrument.

As described above the intensity distributions of $H_3O^+$ and $H_3O^+(H_2O)_n$ (with n>0) measured at 14 mainly reflect the E/N of the very final region of RF device 13, shortly before the ions enter the high vacuum of 14, but not the E/N of 12. The E/N of RF device 13 is position dependent because of the nature of ion funnels. That is, the E/N of the regions where the vast majority of chemical ionization processes of the analytes take place is not reflected by the intensity distributions of $H_3O^+$ and $H_3O^+(H_2O)_n$ (with n>0) measured at 14.

Procedure to Determine PE/N Database

In one embodiment of determining the settings for different PE/N values, the inlet line of the RF/IMR-MS instrument in FIG. 1 and the inlet line of a classic IMR-MS instrument, i.e. basically the same instrument, but with a common exit aperture in 12 instead of the ion funnel 13, are connected via a T-piece so that they analyze a sample in parallel. An analyte is added at a constant volume mixing ratio to the matrix (e.g. air, $N_2$, etc.) and introduced continuously into the shared inlet line. The classic IMR-MS instrument is set to a distinct actual E/N (e.g. 130 Td), e.g. by setting the corresponding DC voltage applied to the drift tube 12. The ratios between the main product ions are determined. There should be at least two product ions in order to get a ratio, but more product ions will lead to a higher accuracy of the PE/N method.

In case the RF/IMR-MS instrument is set to the same pressure and temperature in the reaction region (here the reaction region is formed by 12 and 13) and the same ion source conditions as the classic IMR-MS instrument and the RF frequency of 13 is set to a fixed value, the ion chemistry in the RF/IMR-MS instrument is mainly influenced by three parameters: DC voltage applied to 12, RF amplitude applied to 13 and DC voltage applied to 13. Thus, in this particular case these three are the set of parameters connected to the PE/N value and the values of these three parameters are the corresponding settings, i.e. they are the PE/N settings. In an (iterative) experimental procedure the three parameters are adjusted in a way, so that the ratios of the product ion yields match the ratios determined with the classic IMR-MS instrument. In an experimental procedure a match will only be possible to a certain degree, thus an approximation can be used, e.g. by looking for settings within a 5 or 10% error range. Preferably any instrumental background contributing to the ion yields at the m/z of the product ions should be subtracted from the product ion yields prior to calculating the ratios for both instruments. Preferably the product ion yields are corrected for mass dependent ion transmission into the mass spectrometer prior to calculating the ratios for both instruments.

Preferably the procedure up to this point is repeated for more than one actual E/N set at the classic IMR-MS instrument, so that a range of PE/N values is covered. However, as changes in E/N of less than e.g. 5 Td in most cases only have a minor influence on the branching ratios, in order to cover a range of PE/N values e.g. from 80 to 200, a step-width of 5-50 might be sufficient.

Preferably the PE/N settings are verified for more than one analyte. As described before, the electric field in an RF/IMR-MS instrument can be extremely complex. Therefore, if for a distinct analyte one set of PE/N settings produces branching ratios that are comparable to the branching ratios obtained with a classic IMR-MS instrument for same analyte, this may not necessarily be the case for all analytes. If the branching ratios for the compound(s) used to verify PE/N settings do not match or approximate the branching ratios obtained with a classic IMR-MS instrument, new PE/N settings that match or approximate the branching ratios obtained with a classic IMR-MS instrument for all utilized compounds should be looked for.

PE/N settings that match or approximate the branching ratios obtained with a classic IMR-MS instrument can also be found by analyzing more than one compound simultaneously, e.g. by injecting a mixture of more than one compound to the inlet flow. In this case the compounds should have different product ions, so that the matching or approximation for more than one compound can be set in one experimental process.

If no PE/N setting can be found that match or approximate all branching ratios obtained with a classic IMR-MS instrument of all investigated compounds with a satisfying accuracy, different PE/N settings for distinct compound groups can be created.

In case a user needs to predominantly analyze one specific compound with the RF/IMR-MS instrument, the PE/N settings can preferably be optimized for a best match of the branching ratios of this compound with the branching ratios obtained with a classic IMR-MS instrument.

As an alternative to a classic IMR-MS instrument being operated in parallel to the RF/IMR-MS instrument, in case the RF/IMR-MS instrument can be switched to a classic IMR-MS instrument (e.g. by running 13 in DC mode only), data obtained in classic IMR-MS mode can be used to determine the PE/N settings in RF/IMR-MS mode.

Alternatively, the samples can be first analyzed with a classic IMR-MS instrument, e.g. at a different location, and the data of this measurement can be used to determine the PE/N settings at the RF/IMR-MS instrument while analyzing the same or comparable samples.

Alternatively, data can be taken from literature (e.g. published branching ratios, product ion yield intensities, etc.) to determine the PE/N settings at the RF/IMR-MS instrument.

One example of how the obtained PE/N settings can be stored is given in FIG. 2. At least for one compound group one PE/N value and the corresponding set of instrumental parameters (settings) is stored in this database. Optionally, arbitrary amounts of additional PE/N values and corresponding settings can be stored for an arbitrary amount of additional compound groups, respectively.

In one embodiment additionally the corresponding intensity distributions of reagent ions (in case of hydronium: $H_3O^+$ and $H_3O^+(H_2O)_n$ (with n>0)) of the classic IMR-MS instrument can be stored under "settings". Even PE/N settings that reproduce product ion branching ratios of a classic IMR-MS instrument with outstanding accuracy will still suffer from the problem that the reagent ion intensity distributions measured with the mass spectrometer/detector will predominantly mirror the E/N of the final part of the reaction region. Thus, in order to correct the reagent ion intensity distributions, the original distributions of the classic IMR-MS instrument at the respective actual E/N can be taken as a reference.

In one embodiment PE/N values and corresponding settings between experimentally determined PE/N values can be interpolated. In a simple embodiment the interpolation is a linear interpolation: e.g. if the settings for PE/N values at 130 and 140 Td are known from the experiment to be 10 and 20 V for the RF amplitude, respectively, the interpolated settings for PE/N values 131, 132, . . . , 139 Td are 11, 12, . . . , 19 V for the RF amplitude, respectively. Higher order interpolation may lead to improved results. Interpolation may also be performed by fitting the interpolation functions to more than two experimentally determined settings for PE/N values, e.g. by fitting higher order functions to all settings for all experimentally determined PE/N values. In this way also settings for PE/N values below and above the lowest and highest experimentally determined settings for PE/N values can be extrapolated.

In one embodiment the database entries for different compound groups can in part or in full be used for storing PE/N values and corresponding settings for different matrices. Although in IMR-MS commonly trace compounds are detected and/or quantified in the matrix air/$N_2$, in some fields of application other matrices may be of advantage (e.g. $CO_2$, He, Ar, high or low humidity, etc.). The matrix has a strong effect on the effects the actual E/N has on ion chemistry. Thus different PE/N settings corresponding to PE/N values may be necessary.

In one embodiment the PE/N values are not stored with the corresponding values of the settings (e.g. voltages, frequencies, currents, etc.) but with respective interpolation functions, so that the respective values can be calculated via these functions.

In one embodiment PE/N settings corresponding to PE/N values can be optimized in a way that the resulting branching ratios of analytes not only match or approximate the branching ratios of a classic IMR-MS instrument at the respective actual E/N, but also maximize the sensitivity of the RF/IMR-MS instrument. In many cases there will be a multitude of settings that give comparable branching ratios, thus it can be favorable to choose those settings that simultaneously give the highest sensitivity.

In one embodiment the procedure of finding PE/N settings corresponding to PE/N values can be automated. In this case the anticipated branching ratios of distinct product ions of a distinct compound can be set together with a maximum allowable error range, the PE/N settings that should be varied (e.g. DC voltage applied to 12, RF amplitude applied to 13 and DC voltage applied to 13), the ranges of these PE/N settings and the step-width (e.g. DC voltage applied to 12, range 100-1000 V, 20 V step-width, etc.). By iteration (e.g. by simply scanning the defined ranges with the defined step-widths, by appropriate mathematical functions, etc.) the PE/N settings that result in the set branching ratios (within the set error range) are found by the automation process.

Method of and Device for Applying PE/N

Figure 3:
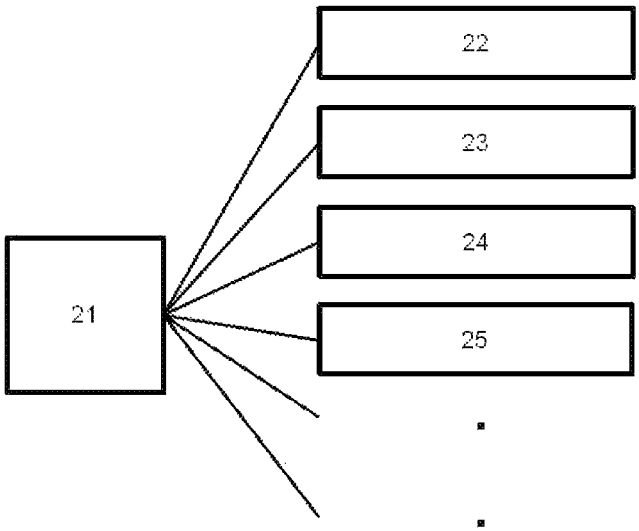
FIG. 3 shows devices of the RF/IMR-MS instrument controlled by the PE/N method/device

The RF/IMR-MS instrument is controlled by the method and device schematically shown in FIG. 3.

The controlling device 21 allows for entering a PE/N value (either by the user or via transmission from another device) and controls devices (22-25- . . . ) capable of influencing the ion-molecule reactions in the reaction region of the RF/IMR-MS instrument according to the corresponding settings in the database, which was created according to the procedure in the previous section. In FIG. 3 only four devices are exemplarily labeled (22-25), but an arbitrary amount of devices can be controlled. Controlling the devices can have, but is not limited to, the following effects on the reaction region of an RF/IMR-MS instrument:

Change RF amplitudes
Change RF frequencies
Change RF phases
Change DC voltages
Change temperatures
Change pressures Thus examples for controlled devices are:

RF generators
Amplifiers
Power supplies
Temperature controllers
Pressure controllers
Valves
Pumps In one embodiment the method and device can be utilized in "reverse mode", i.e. the user or another device sets the voltages, currents, frequencies, etc. of each device and the method and device returns the corresponding PE/N value. In case the settings do not match any entry in the database exactly, the best fit can be returned.

ILLUSTRATIVE EMBODIMENT

In order to give an example of how the present method and device of invention works, we performed the following experiment. The RF/IMR-MS instrument we used is the one schematically shown in FIG. 1, i.e. based on a common classic design with a hollow cathode ion source 11, a conventional DC drift tube with ring electrodes 12 and a TOF mass spectrometer with a microchannel plate detector 14. What transforms this instrument into a RF/IMR-MS instrument is that between 12 and 14 an RF ion funnel 13 is installed. The pressure in 13 is identical to the pressure in 12 (2.3 hPa), i.e. 13 is part of the reaction region. The length of 13 is about ⅓ of the length of 12 (ratio about 3:9.5 cm). Thus, although the exact contribution of 13 to the ionization process of the analytes is unknown (because of the underlying problem the present invention is dealing with), it is clear that the contribution of 13 cannot be neglected. It should be noted that this example and the choice of instrument by no means limits the invention to this particular type of RF/IMR-MS instrument. The invention can be applied to all RF/IMR-MS instruments, including, but not limited to, the RF/IMR-MS instruments mentioned under "Problem to be solved".

As a classic IMR-MS instrument we used a second instrument that had a very similar setup to the RF/IMR-MS instrument, but was missing the RF ion funnel 13. Thus, for this instrument the E/N could be easily calculated with equations (1) and (2). Both instruments were connected in parallel for simultaneous sampling. The temperatures of the reaction regions and of the sample inlet were set to an equal value (80° C.) and both instruments were operated at equal pressures in the reaction regions (2.3 hPa).

As the sample for building the PE/N database we injected the headspace of octanal ($C_8H_{16}O$) in a bag previously filled with pure $N_2$. As reagent ions we chose $H_3O^+$. From literature we know that PTR ionization of octanal with $H_3O^+$ predominantly produces the protonated molecule (nominal m/z 129) and two fragment ions (nominal m/z 111 and m/z 69; K. Buhr, S. van Ruth, C. Delahunty, *Analysis of flavour compounds by Proton Transfer Reaction-Mass Spectrometry: fragmentation patterns and discrimination between isobaric and isomeric compounds*. International Journal of Mass Spectrometry 221 (2002) 1-7). Thus, we recorded the ion yields (corrected for mass dependent transmission of the classic IMR-MS instrument) for these three product ions at distinct actual E/N values (range 77-177 Td; steps of about 10 Td). The setting for adjusting the actual E/N in the classic IMR-MS instrument was the voltage applied to the drift tube 12. For each actual E/N setting of the classic IMR-MS instrument, we tried to reproduce the intensity ratios (corrected for mass dependent transmission of the RF/IMR-MS instrument) between the three product ions at the RF/IMR-MS instrument by adjusting three parameters: DC voltage applied to 12, RF amplitude applied to 13, DC voltage applied to 13. As soon as settings were found that reproduced the product ion intensity ratios within a maximum of 10% error, the actual E/N value of the classic IMR-MS instrument was stored as the PE/N value and the corresponding settings of the three parameters as PE/N settings in the database. This process was repeated for all steps in the covered range.

Figure 4:
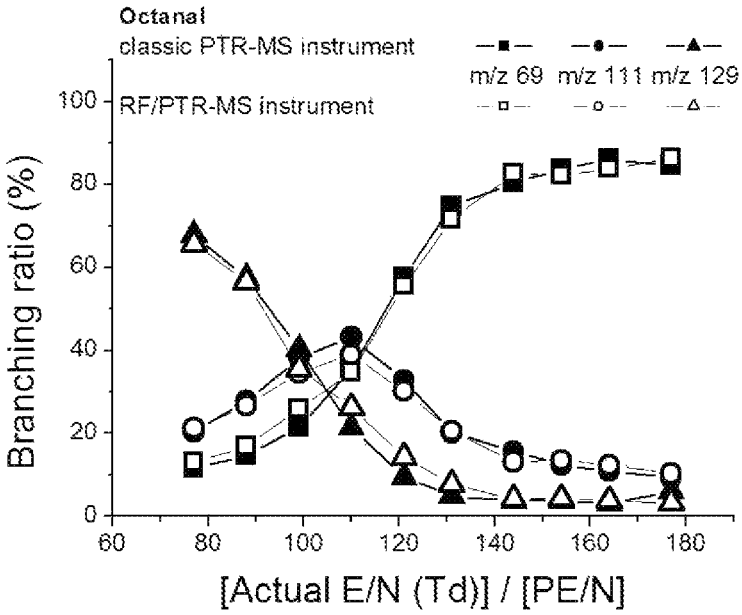
FIG. 4 shows branching ratios of Octanal: comparison of data from classic and RF/IMR-MS instrument. Connecting lines are used to guide the eye.

As a first verification we repeated the experiment with the diluted octanal headspace. For the classic IMR-MS instrument the actual E/N was set via the voltage applied to the drift tube 12. The method and device of the invention was used for the RF/IMR-MS instrument, i.e. the PE/N value corresponding to the actual E/N of the classic IMR-MS instrument was set. The results for the range between 77 and 177 (Td) in about 10 (Td) steps are shown in FIG. 4. The solid symbols represent the results obtained with the classic IMR-MS instrument and the open symbols the results obtained with the RF/IMR-MS instrument, whereas the full heights of the symbols are about 4%. It can be seen that all ratios are reproduced with the RF/IMR-MS instrument using the method and device of the invention with less than 10% error.

Figure 5:
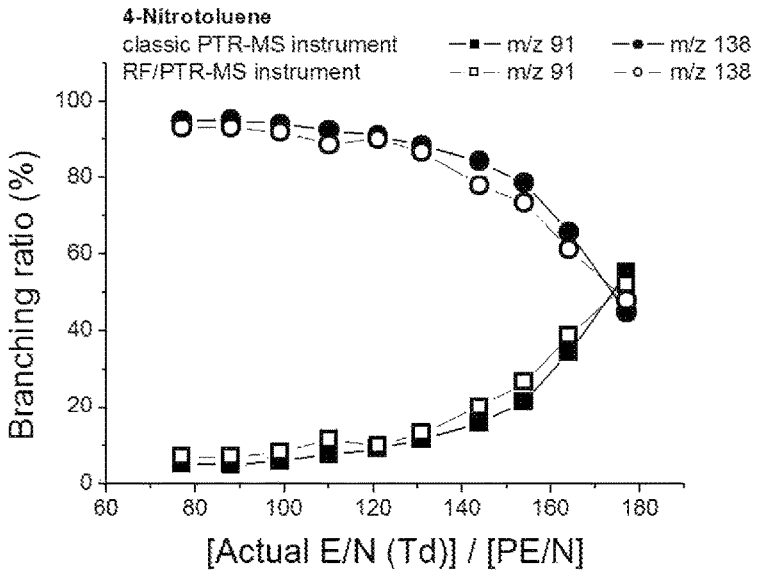
FIG. 5 shows branching ratios of 4-Nitrotoluene: comparison of data from classic and RF/IMR-MS instrument. Connecting lines are used to guide the eye.

For a second verification we chose a different compound, namely 4-nitrotoluene ($C_7H_7NO_2$). For this molecule we found that two of the main product ions are the protonated molecule (nominal m/z 138) and a fragment ion (nominal m/z 91). Saturated headspace of 4-nitrotoluene was injected into a bag previously filled with pure $N_2$ and analyzed in parallel with both instruments. For the classic IMR-MS instrument the actual E/N was set via the voltage applied to the drift tube 12. The method and device of the invention was used for the RF/IMR-MS instrument, i.e. the PE/N value corresponding to the actual E/N of the classic IMR-MS instrument was set. The results for the range between 77 and 177 (Td) in about 10 (Td) steps are shown in FIG. 5 (heights of the symbols are about 4%). They demonstrate, that although the entries of the database had been created while adjusting the instrument to octanal, they work perfectly well also for 4-nitrotoluene.

Advantages of the Invention

One of the advantages of RF/IMR-MS instruments is their improved sensitivity, but determining the actual E/N of such instruments is often difficult or impossible. However, without information on the E/N it is impossible to obtain meaningful measurement results. With the PE/N method and device this problem is solved, as it provides a simple and efficient way of linking measurement results of RF/IMR-MS instrument to actual E/N of classic IMR-MS instruments. Thus, in addition to the basic advantage of improved sensitivity of RF/IMR-MS instruments, the advantages of classic IMR-MS instruments are preserved by the invention: simple quantification via calculation, improved substance identification via branching ratios, comparability of measurement results obtained with different IMR-MS instruments, etc.

The invention claimed is:

1. Ion-molecule-reaction mass spectrometry (IMR-MS) device, comprising:

(i) an ion source, (ii) an adjacent reaction chamber, and (iii) a mass spectrometer subsequent to the reaction chamber, wherein the reaction chamber comprises an RF device for creating a temporally changing electromagnetic field, and wherein an adjustable reduced electric field strength can be applied to the reaction chamber, further comprising an input device for entering a desired reduced electric field strength by an operator when operating said IMR-MS device for analysing a sample, and a controlling device that operates the IMR-MS device by adjusting the settings of the IMR-MS device relating to a defined data set of a pseudo reduced electric field strength for the entered reduced electric field strength, wherein the pseudo reduced electric field strength has been determined by analysing a first analyte in the IMR-MS device, wherein intensity signals of at least two product ions of the first analyte are recorded, and wherein the settings of the IMR-MS device are changed until the measured intensity signal ratios of the at least two product ions match reference intensity signal ratios within a given tolerance level of the at least two product ions determined in an IMR-MS device comprising an ion source, an adjacent reaction chamber with a DC-drift tube, and a mass spectrometer subsequent to the reaction chamber, wherein the reaction chamber is operated only with an activated DC-drift tube at a certain actual reduced electric field strength, wherein these settings of the IMR-MS device relating to the pseudo reduced electric field strength are stored in the controlling device, and wherein the controlling device controls said IMR-MS device by performing analysis of the sample with the settings corresponding to the pseudo reduced electric field strength.

2. The IMR-MS device according to claim 1, wherein said controlling device operates the IMR-MS device by taking the settings of the IMR-MS device relating to at least two data sets of pseudo reduced electric field strengths for the entered reduced electric field strength, by analysing a second analyte, wherein the procedure for the first analyte is repeated for the at least second analyte to obtain a second pseudo reduced electric field strength, and wherein the controlling device operates said IMR-MS device by performing analysis of the sample with the setting corresponding to the at least two pseudo reduced electric field strengths.

3. The IMR-MS device according to claim 1, wherein the reference intensity signals of the at least two product ions are taken from a database.

4. The IMR-MS device according to claim 1, wherein the reference intensity signals of the at least two product ions were measured in an IMR-MS device comprising an ion source, an adjacent reaction chamber with a DC-drift tube, and a mass spectrometer subsequent to the reaction chamber, wherein the reaction chamber is operated with an activated DC-drift tube at a certain actual reduced electric field strength with a de-activated RF device if present.

5. The IMR-MS device according to claim 1, further comprising a DC-drift tube in said reaction chamber.

6. The IMR-MS device according to claim 5, wherein the reference intensity signals ($RS_{1,2}$) are determined in said IMR-MS device with an activated DC-drift tube and de-activated RF device.

7. The IMR-MS device according to claim 1, wherein said RF device is an ion funnel.

8. The IMR-MS device according to claim 1, wherein said RF device is a multipole ion guide.

9. A method of analysing a sample by an ion molecule reaction—mass spectrometry (IMR-MS) device that comprises (i) an ion source, (ii) an adjacent reaction chamber, and (iii) a mass spectrometer subsequent to the reaction chamber, wherein an adjustable reduced electric field strength can be applied on the reaction chamber, the reaction chamber comprising a RF device for creating a temporally changing electromagnetic field, wherein an operator may enter a desired reduced electric field strength when operating said IMR-MS device, wherein the settings of the IMR-MS device are adjusted to settings relating to a defined data set of a pseudo reduced electric field strength for the entered reduced electric field strength, wherein the pseudo reduced electric field strength has been determined by analysing a first analyte in an IMR-MS device, wherein intensity signals of at least two product ions of the first analyte are recorded, and wherein the settings of the IMR-MS device are changed until the measured intensity signal ratios of the at least two product ions match reference intensity signal ratios within a given tolerance level of the at least two product ions determined in an IMR-MS device comprising an ion source, an adjacent reaction chamber with a DC-drift tube, and a mass spectrometer subsequent to the reaction chamber, wherein the reaction chamber is operated only with an activated DC-drift tube at a certain actual reduced electric field strength, wherein these settings of the IMR-MS device are stored relating to the pseudo reduced electric field strength, and wherein the IMR-MS device is operated by using the settings of the IMR-MS device stored as pseudo reduced electric field strength performing analysis of the sample with the settings corresponding to the pseudo reduced electric field strength.

10. A method of calibrating an ion molecule reaction—mass spectrometry (IMR-MS) device that comprises (i) an ion source, (ii) an adjacent reaction chamber, and (iii) a mass spectrometer subsequent to the reaction chamber, wherein the reaction chamber comprises a RF device for creating a temporally changing electromagnetic field and wherein an adjustable reduced electric field strength can be applied to the reaction chamber, comprising a controlling device that operates the IMR-MS device by adjusting the settings of the IMR-MS device relating to a defined data set of a pseudo reduced electric field strength for the entered reduced electric field strength, wherein the pseudo reduced electric field strength is determined by analysing a first analyte in the IMR-MS device, wherein intensity signals of at least two product ions of the analyte are recorded, and wherein the settings of the IMR-MS device are changed until the measured intensity signal ratios of the at least two product ions match reference intensity signal ratios within a given tolerance level of the at least two product ions determined in an IMR-MS device comprising an ion source, an adjacent reaction chamber with a DC-drift tube, and a mass spectrometer subsequent to the reaction chamber, wherein the reaction chamber is operated only with an activated DC-drift tube at a certain actual reduced electric field strength, wherein these settings of the IMR-MS device relating to the pseudo reduced electric field strength ($PE/N_1$) are stored in the controlling device.

* * * * *